US011204176B2

(12) United States Patent
Bellini

(10) Patent No.: US 11,204,176 B2
(45) Date of Patent: Dec. 21, 2021

(54) GAS COOKER AND METHOD OF OPERATION OF SUCH GAS COOKER

(71) Applicant: CAN S.R.L., Bassano del Grappa (IT)

(72) Inventor: Mauro Bellini, Desenzano del Garda (IT)

( * ) Notice: Subject to any disclaimer, the term of this patent is extended or adjusted under 35 U.S.C. 154(b) by 171 days.

(21) Appl. No.: 16/622,931

(22) PCT Filed: Jun. 28, 2018

(86) PCT No.: PCT/IB2018/054787
§ 371 (c)(1),
(2) Date: Dec. 16, 2019

(87) PCT Pub. No.: WO2019/003167
PCT Pub. Date: Jan. 3, 2019

(65) Prior Publication Data

US 2021/0148578 A1 May 20, 2021

(30) Foreign Application Priority Data

Jun. 28, 2017 (IT) ..... 102017000072456

(51) Int. Cl.

| | |
|---|---|
| ***F24C 15/00*** | (2006.01) |
| ***F24C 3/00*** | (2006.01) |
| ***F24C 15/20*** | (2006.01) |
| ***F24C 15/32*** | (2006.01) |

(52) U.S. Cl.
CPC ..... *F24C 15/001* (2013.01); *F24C 3/008* (2013.01); *F24C 15/2007* (2013.01); *F24C 15/2042* (2013.01); *F24C 15/32* (2013.01)

(58) Field of Classification Search
CPC ..... F24C 15/001; F24C 15/2007; F24C 15/2042; F24C 15/32; F24C 15/2021; F24C 15/36
See application file for complete search history.

(56) References Cited

U.S. PATENT DOCUMENTS

| | | | | |
|---|---|---|---|---|
| 2,526,890 A | | 10/1950 | Mendel | |
| 2,536,513 A | * | 1/1951 | O'Keefe | F24C 3/124 126/39 N |
| 3,132,638 A | | 5/1964 | Habe | |
| 4,133,336 A | | 1/1979 | Smith | |

FOREIGN PATENT DOCUMENTS

| | | |
|---|---|---|
| GB | 2494866 | 3/2013 |
| KR | 100389410 | 6/2003 |

* cited by examiner

*Primary Examiner* — Jorge A Pereiro
(74) *Attorney, Agent, or Firm* — Themis Law

(57) ABSTRACT

A gas cooker includes a housing delimiting an upper and a lower compartment divided by a plate and communicating through slits formed in the plate; a hob having a plurality of burners; an oven housed in the lower compartment and having a front opening, a pivoting door selectively closing the lower compartment, and a grill device; a front panel having controls elements connected to the burners and the oven; and an exhaust path for fumes and combustion products of the oven. The gas cooker further includes a folded metal sheet disposed in the upper compartment by the slits and having lateral edges contacting the plate to define a conduit between the slits and the exhaust path, and separate the exhaust path from the rest of the upper compartment which houses the control element, so as to prevent the control elements and the front panel from overheating.

9 Claims, 4 Drawing Sheets

GAS COOKER AND METHOD OF OPERATION OF SUCH GAS COOKER

FIELD OF THE INVENTION

The present invention generally finds application in the field of kitchen appliances and particularly relates to an improved gas cooker.

In a further aspect, the invention relates to a method of operation of such improved gas cooker.

BACKGROUND ART

Compact gas cookers have been long known to be used in the field of boat and caravan appliances, which comprise a box-like housing made of sheet metal with a gas oven accommodated in a lower compartment and a hob with gas burners located on top of an upper compartment.

Generally, the box-like housing is composed of a pair of side walls, a rear wall and a front wall having an opening that is designed to be vertically closed by a door hinged to the lower edge of the compartment.

Furthermore, the oven comprises a respective burner having nozzles ejecting a mixture of gas and air and a gas grill device for cooking food with different cooking methods.

The oven, the grill device and the burners are typically controlled and adjusted by appropriate control means, preferably knobs, placed on the front part of the box-like housing, in a front panel mounted to the front edge of the upper compartment and in a position in which they can be accessed from the outside by a user.

In order to promote migration of heat from the inside out and, as a result, facilitate evacuation of combustion products and control temperature during grill cooking, the oven door is kept in a partially open position with a predetermined tilt to the opening.

A first drawback of these arrangements is that the control means are prone to overheating during operation of the above described oven, both due to radiation from the grill device and due to the combustion products that come out of the front open and rise upwards.

This drawback prevents the user from relying on a minimum operation safety, as he/she may burn his/her hands on the knobs of the control means, and does not ensure compliance with the European Standard EN30 concerning safety of domestic appliances.

Furthermore, due to the small size of this type of cookers, the various parts of the oven are poorly shielded against conduction heat transfer, due to the lack of adequate thermal-insulation arrangements.

In an attempt to at least partially obviate these drawbacks, gas cookers have been developed, having movable baffles interposed between the control means and the opening of the door, and adapted to deflect the hot air flow to the sides of the door.

In addition to these baffles, insulating systems have been developed for insulating the inner walls of the oven using low-conductivity materials.

A first drawback of these arrangements is that the movable baffles do not allow effective evacuation of fumes and combustion products from the oven to the outside environment.

The combustion products have a very high temperature and tend to overheat the components of the control means as they flow into the upper compartment of the gas cooker.

A further drawback is the lack of a complete thermal separation between the baffle, which is made of a metal material, and the front panel.

This drawback causes conduction heat transfer between the baffle and the front panel, leading to overheating of the control means.

One more drawback of these arrangements is that the baffles have a large size and have a complex installation.

U.S. Pat. No. 4,133,336, KR20020039905 and U.S. Pat. No. 2,526,890 disclose gas cookers having a box-like housing containing a hob and an oven respectively and having an upper compartment and a lower divided by a metal plate. Furthermore, these gas cookers comprise an exhaust path for fumes and combustion products.

GB2494866 discloses a gas cooker as defined in the preamble of claim 1 which has an exhaust path for fumes in fluid communication with a flue located between the upper compartment and the lower compartment to improve exhaust of fumes.

Nevertheless, also these cookers do not ensure complete thermal separation between the baffle and the front panel, leading to overheating of the control means.

Technical Problem

In the light of the prior art, the technical problem addressed by the present invention is to provide an improved gas cooker that can prevent overheating of the user-operable control means operable and quickly and effectively evacuate the combustion products.

DISCLOSURE OF THE INVENTION

The object of the present invention is to obviate the above drawback, by providing an improved gas cooker and a method of operation thereof, that are highly efficient and relatively cost-effective.

A particular object of the present invention is to provide an improved gas cooker that prevents overheating of the user-operable control means.

Another object of the present invention is to provide an improved gas cooker that affords quick and effective exhaust of fumes and combustion products.

A further object of the present invention is to provide an improved gas cooker that ensures adequate thermal insulation between the internal parts and the control means.

Another object of the present invention is to provide an improved gas cooker that limits radiation from the grill device.

Yet another object of the present invention is to provide an improved gas cooker that has a very reduced size and is easy to assemble.

These and other objects, as more clearly explained hereafter, are fulfilled by an improved gas cooker as defined in claim 1, which comprises a box-like housing delimiting an upper compartment and a lower compartment, the compartments being divided by a substantially horizontal metal plate interposed therebetween and in fluid communication with each other through a series of slits formed in the metal plate.

The gas cooker also comprises a hob located on top of the upper compartment and comprising a plurality of burners, an oven housed in the lower compartment and comprising a front opening, a door for selectively closing the compartment and at least one drill device and a front panel mounted to the front edge of the upper compartment and comprising control means connected to the burners and the oven and operable by a user.

An exhaust path is further provided for the fumes and the combustion products from the oven, which extends in the rear portion of the box-like housing.

In a peculiar aspect of the invention, the gas cooker comprises a folded metal sheet accommodated in the upper compartment at the slits and having lateral lower edges contacting the metal plate to define a conduit adapted to establish fluid communication between the slits and the exhaust path and separate it from the rest of the upper compartment which houses the control means, to prevent them and the front panel from being overheated.

In a further aspect, the invention relates to a method of operation of such improved gas cooker as defined in claim 10.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of an improved gas cooker of the invention, which is described as a non-limiting example with the help of the following drawings, in which.

DETAILED DESCRIPTION OF A PREFERRED EXEMPLARY EMBODIMENT

Particularly referring to the figures, there is shown an improved gas cooker of the invention, generally designated by numeral 1, which is particularly but not exclusively suitable to be installed in environments having narrows spaces, such as boats, caravans, recreational vehicles, or the like.

Figure 6:
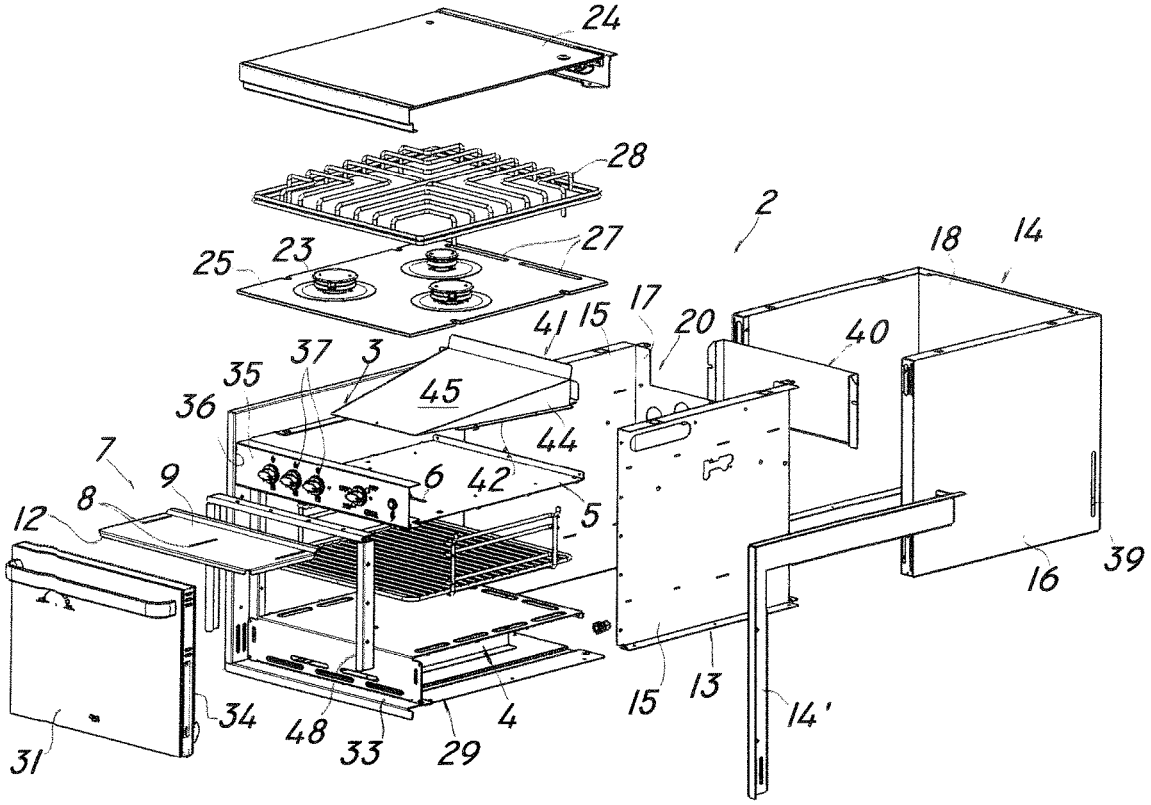
FIG. 6 is an exploded perspective view of the gas cooker of FIG. and its main parts.
Figure 9:
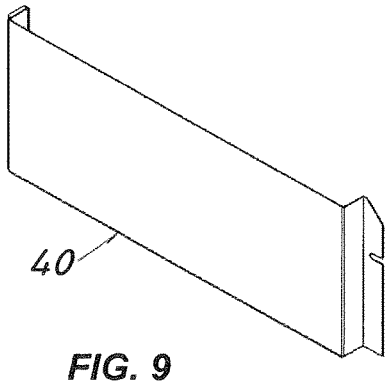

As shown in the figures, the cooker 1 comprises a box-like housing 2 delimiting an upper compartment 3 and a lower compartment 4. The compartments 3, 4 are divided by a substantially horizontal metal plate 5 interposed therebetween, as best shown in FIGS. 6 and 9.

Furthermore, the upper compartment 3 and the lower compartment 4 are in fluid communication with each other through a plurality of slits 6 formed in the metal plate 5. In the embodiment as shown in the figures, two elongate adjacent slits 6 are provided, but additional slits may be provided in different positions, without departure from the scope of the present invention.

Conveniently, a substantially horizontal first baffle 7 may be provided, for selectively providing fluid communication between the upper compartment 3 and the lower compartment 4.

Namely, the first baffle 7 may be slidingly coupled to the horizontal metal plate 5 to move from a first retracted position in which it blocks the slits 6 and prevents fluid communication between the lower compartment 4 and the upper compartment 3 and a second extended position in which it does not block the slits 6 and allows fluid communication between the lower compartment 4 and the upper compartment 3.

A plurality of slots 8 may be provided, e.g. in middle and side positions relative to the flat top surface 9 of the first baffle 7, for receiving corresponding vertical pins 10 mounted to the horizontal plate 5 and allow the first baffle 7 to slide.

The pins 10 may be mounted on the bottom surface 11 of the metal plate 5 and the first baffle 7 may be slidingly coupled thereto from the lower compartment 4.

Furthermore, the first baffle 7 may have a substantially horizontal folded front edge 12 for improved grip by a user during sliding into the first and second positions.

As best shown in FIG. 6, the box-like housing 2 may comprise an inner frame 13 and an outer frame 14, both having a U shape with respective side walls 15, 16 and rear walls 17, 18, delimiting a cavity 19 and a pair of side edges 14' coupled to the inner frame 13.

The rear wall 17 of the inner chassis 13 comprises a first opening 20 providing communication of the upper compartment 3 with the cavity 19 and a plurality of holes 21 providing fluid communication between the lower compartment 4 and the cavity 19.

The improved gas cooker 1 comprises a hob, placed on the top thereof to delimit the upper compartment in combination with the horizontal plate 5, and comprising a plurality of burners 23 and a pivoting cover 24, adapted to move from a lifted position to a lowered position and vice versa.

The hob 22 may comprise a top plate 25 with a plurality of receptacles 26 for respective burners 23 and a plurality of exhaust passages 27, providing fluid communication between the aforementioned cavity 19 and the outside environment when the cover 24 is in the lifted position.

As is known per se, the hob 22 may be further coupled at its top with a grate 28 for supporting cookware and having such a size as to be able to cover the burners 23.

The lower compartment 4 has an oven 29 accommodated therein, which has a front opening 30, a pivoting door 31 for selectively closing the compartment 4, a grill device 32 and a respective gas burner 32'.

Namely, the door 31 is hinged to a composite support 33 which is composed of the metal plates of the bottom of the oven 29, the side frames 14' and the outer chassis 14.

Figure 1:
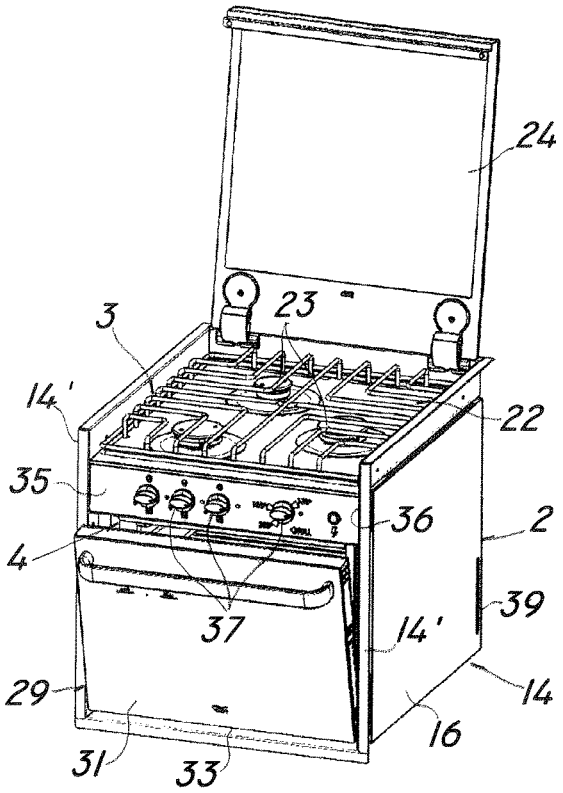
FIG. 1 is a perspective view of a fully assembled gas cooker of the invention according to a respective operating configuration.
Figure 2:
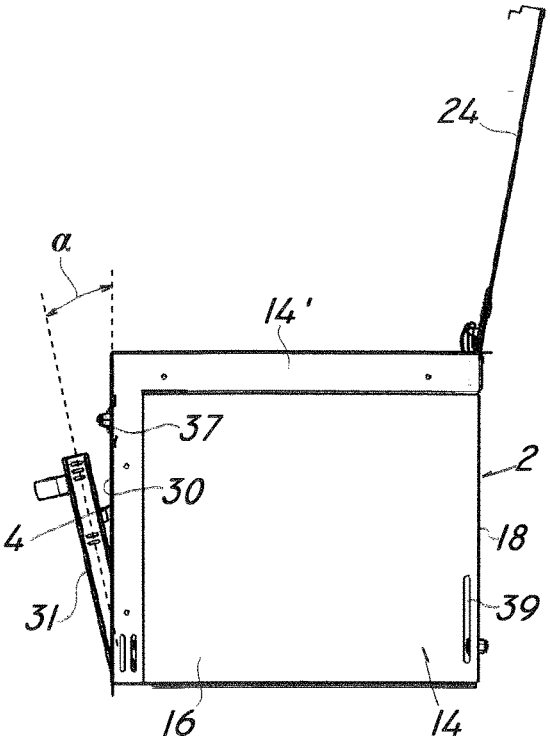
FIG. 2 is a side view of the cooker of FIG. 1.
Figure 3:
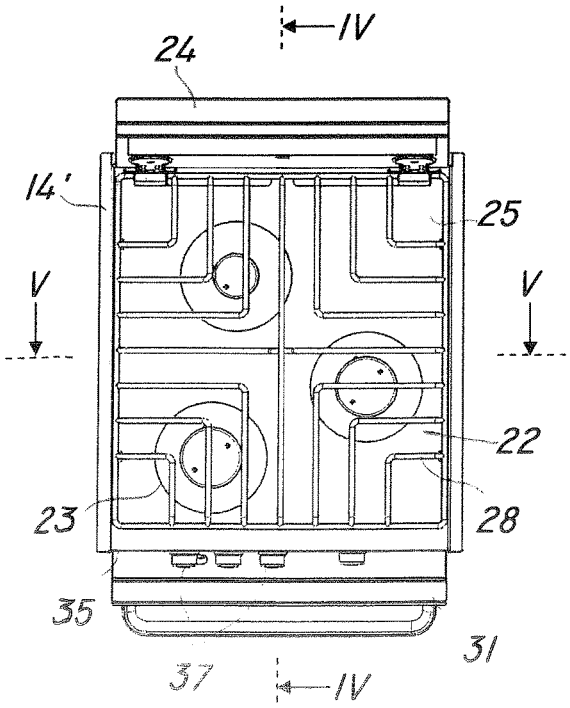
FIG. 3 is a top view of the cooker of FIG. 1.
Figure 4:
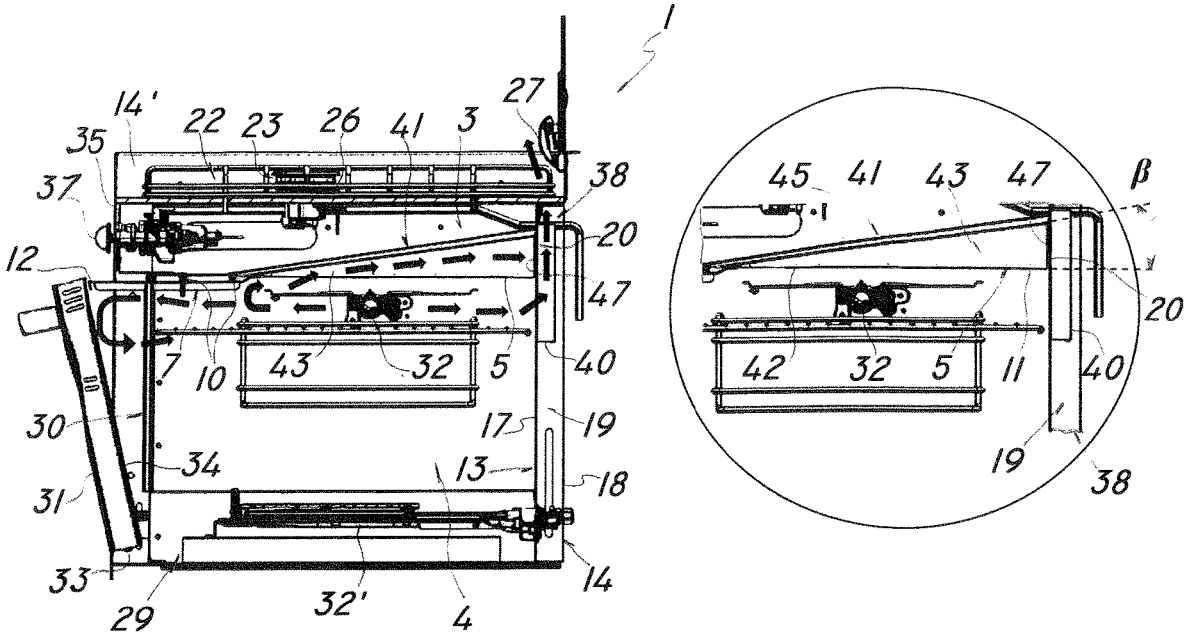
FIG. 4 is a partially sectional view of the cooker of FIG. 3, as taken along the plane IV-IV, as well as an enlarged portion thereof.
Figure 5:
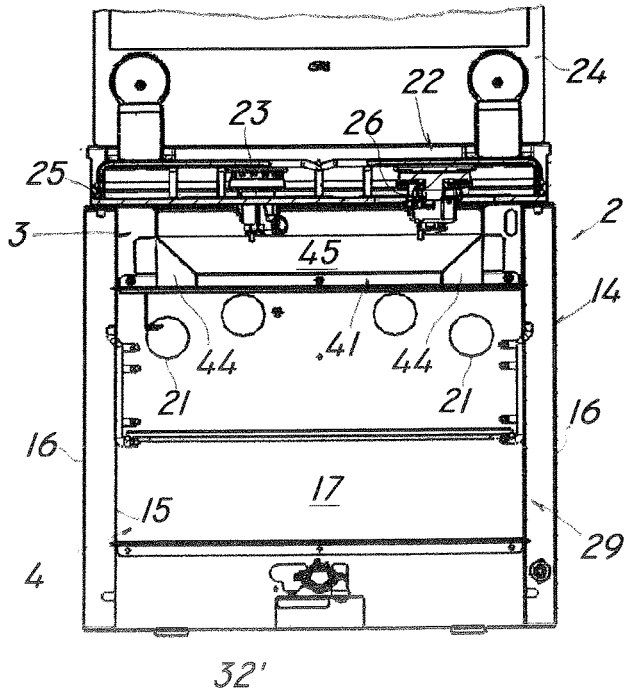
FIG. 5 is a partially sectional view of the cooker of FIG. 3 as taken along the plane V-V.

As best shown in FIG. 4, the grill device 32 is gas fired and may be mounted to the horizontal plate 5 that divides the upper compartment 3 and the lower compartment 4, to irradiate the food in the oven 29 from top to bottom.

Conveniently, the holes 21 formed in the rear wall 17 of the inner chassis 13 will allow the combustion products of the oven 29 to be conveyed toward the cavity 19.

Furthermore, when the grill device 32 is in operation, the door 31 of the oven 29 is kept in a partially open position and inclined with respect to the front opening 30 to promote migration of heat from the inside out and, as a result, facilitate evacuation of combustion products and control temperature, as best shown in the figures.

According to a non-limiting example of the invention, the door 31 may have an inclination angle $\alpha$ of 12.5° relative to the corresponding front opening 30 when it is in the operating position.

In this configuration, the first baffle 7 is slid to the second extended position until its folded front edge 12 abuts the inner surface 34 of the door 31, as shown in FIG. 4.

Then, in addition to promoting fluid communication of the combustion products between the upper compartment 3 and the lower compartment 4, the first baffle 7 also shields radiation of the grill device 32.

A front panel 35 is mounted to the front edge 36 of the upper compartment 3 to close it at the front and comprises control means 37, particularly knobs, connected to the oven 29 and to the burners 23, possibly equipped with a piezoelectric lighter and operable by a user. Particularly, the front panel 35 is joined to the horizontal metal plate 5 and to the side frames 14'.

The control means 27 may comprise a two-way valve with a thermostatic unity to alternately adjust the operation of the grill device 32 or the gas burner 32'.

The gas cooker 1 comprises an exhaust path 38 for the fumes and the combustion products from the oven, which mainly extends in the rear portion of the box-like housing 2.

In particular, as best schematically shown in FIG. 4, the exhaust path 38 may comprise the first opening 20, the holes 21, the cavity 19 and the exhaust passages 27 as described above, for exhaust of the combustion products when the pivoting cover 24 is lifted.

The cavity 19 may have side openings 39 formed on the outer frame 14, for air to flow in from the outside and circulate by chimney effect.

Figure 10:
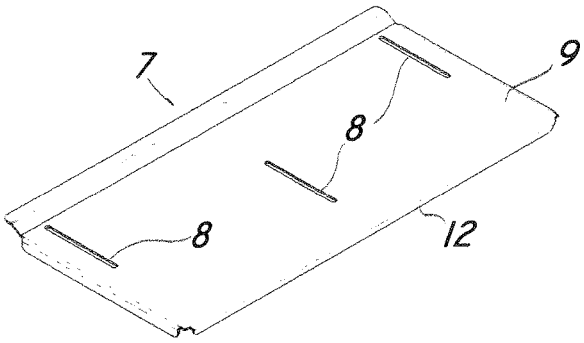

Moreover, a second substantially vertical baffle 40 may be provided, which is held in the cavity 19 and is mounted to the rear wall 17 of the inner chassis 13, as best shown in FIG. 10.

The second baffle 40 is adapted to convey the fumes and the combustion products from the holes 21 to the exhaust passages 27 formed on the hob 22 through the exhaust path 38.

Figure 7:
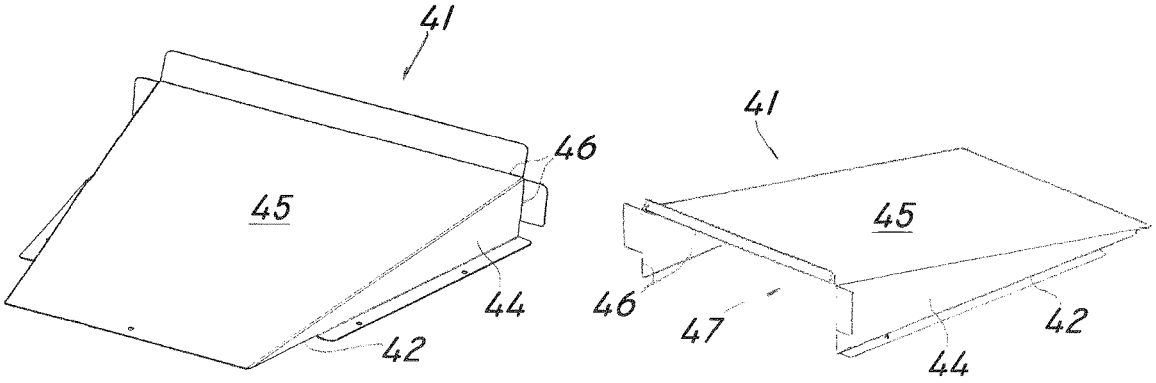
FIGS. 7 to 12 are perspective views of the main parts of the cooker of FIG. 1.
Figure 8:
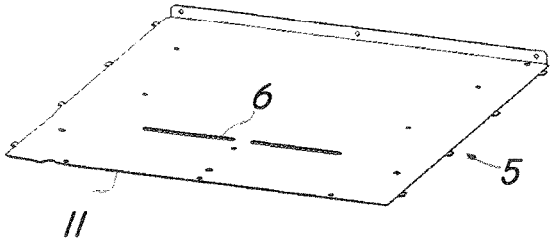

In a peculiar aspect of the invention, the improved gas cooker 1 comprises a folded metal sheet 41 accommodated in the upper compartment 3 at the slits 6, as best shown in FIG. 7.

The sheet 41 has side bottom edges 42 in contact with the metal plate 5 to define a conduit 43 for providing direct fluid communication between the slits 6 and the exhaust path 38.

Furthermore, the folded sheet 41 can separate the conduit 43 from the rest of the upper compartment 3 which houses the control means 37, to prevent the latter and the front panel 35 from being overheated.

Preferably, the metal sheet 41 may have a pair of side walls 44 with the bottom edges 42 in contact with the metal plate 5 and a top surface 45 tilted with respect to the plate 5 with a tilt angle β ranging from 5° to 10°.

The side walls 44 and the top surface 45 comprise respective front edges 46 for delimiting a second substantially vertical front opening 47 that corresponds to the first opening 20 of the rear wall 17 of the inner chassis 13.

In the operating position, the front edges 46 of the metal sheet 41 contact the rear wall 17 of the inner chassis 13 and the first 20 and second 47 openings face each other, to provide fluid communication between the conduct 43 and the cavity 19.

Nevertheless, it shall be noted that the combustion products may be only exhausted from the lower compartment 4 to the cavity 19 through the conduct 43 and the slits 6 when the first baffle 7 is in its extended position in which it does not block the slits 6, as described above.

Furthermore, the second baffle 40 may be accommodated in the cavity 19 to overlie both the first opening 20 and the exhaust holes 21 in the lower compartment 4.

Advantageously, the gas cooker 1 may comprise a silicone seal 48 interposed between the front panel 35 and the metal plate 5 and contacting the top surface 9 of the first baffle 7.

Figure 11:
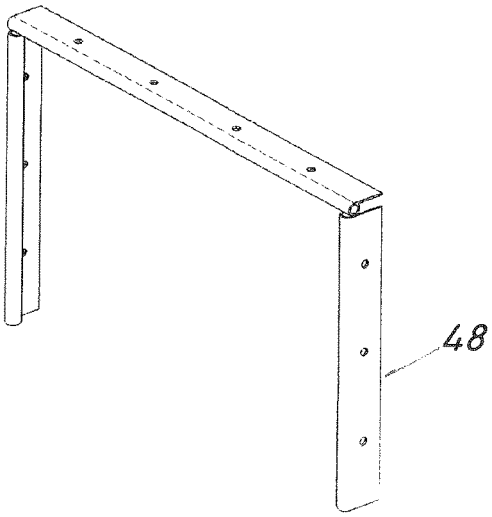
Figure 12:
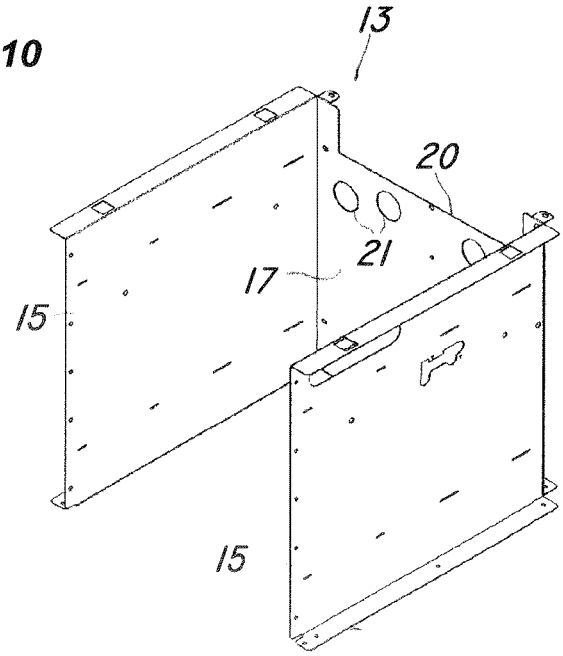

The seal 48, as best shown in FIG. 11, acts as a thermal insulation and creates a discontinuity between the horizontal plate 5 and the front panel 35 and the outer chassis 14 of the box-like housing 2.

In a further aspect, the invention relates to a method of use of the above described improved gas cooker 1.

The method includes a step of a) completely opening the door 31 of the oven 29, a step of b) moving the first baffle 7 from the first retracted position to the second extended position for fluid communication between the lower compartment 4 and the upper compartment 3 through the slits 6 and a step of c) closing the door 31 of the oven 29 until its inner surface 34 abuts the folded edge 12 of the first baffle 7.

Steps are further provided of d) lighting the grill device 32 of the oven 28 using the control means 37 on the front panel 35 and of e) lifting the cover 24 of the hob 22 to promote removal of fumes and combustion products through said conduct 43, said cavity 19 and said exhaust passages 27.

It will be appreciated from the foregoing the improved gas cooker and the method of use thereof fulfill the intended objects and particularly prevent overheating of the control means and afford efficient exhaust of fumes and combustion products.

While the improved gas cooker has been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be produced on an industrial scale in the field of kitchen appliances.

The invention claimed is:

1. A gas cooker (1) comprising:

a box-shaped housing (2) delimiting an upper compartment (3) and a lower compartment (4), said upper and lower compartments (3, 4) being divided by a horizontal metal plate (5) interposed therebetween and being in fluid communication with each other through a series of slits (6) formed in said horizontal metal plate (5);

a hob (22) placed above said upper compartment (3) and comprising a plurality of burners (23) and a pivoting cover (24);

an oven (29) housed in said lower compartment (4), and comprising a front opening (30), a pivoting door (31) for selectively closing said compartment (4), and at least one grill device (32);

a front panel (35) mounted onto a front edge (36) of said upper compartment (3) and comprising control elements (37) connected to said burners (23) and said oven (29) and operable by a user;

an exhaust path (38) for outwardly discharging fumes and combustion products of the oven, wherein said exhaust path (38) extends in a rear portion of said box-shaped housing (2);

a folded metal sheet (41) accommodated in said upper compartment (3) in proximity of said slits (6), said folded metal sheet having lateral lower edges (42) contacting said horizontal metal plate (5) to define a conduit (43) adapted to provide fluid communication between said slits (6) and said exhaust path (38) and to separate said exhaust path from a remainder of the upper compartment (3), which houses said control elements (37), to prevent said control elements and said front panel (35) from overheating; and a first baffle (7) disposed horizontally, said first baffle (7) being slidingly coupled to said horizontal metal plate (5) to move from a first retracted position, in which the first baffle blocks the slits (6) and prevents fluid communication between said lower compartment (4) and said conduit (43) through said slits (6), and a second extended position, in which the first baffle does not block said slits (6) and allows fluid communication between said lower compartment (4) and said conduit (43).

2. The gas cooker as claimed in claim 1, wherein the pivoting door (31) of said oven (29) is kept in a partially open position and tilted with respect to said front opening (30) when said grill device (32) is in operation, a horizontal edge (12) of said first baffle (7) in a second extended position being adapted to abut against said pivoting door (31) when partially open.

3. The gas cooker as claimed in claim 2, wherein said box-shaped housing (2) comprises an inner frame (13) and an outer frame (14) both having a "U" shape with respective vertical rear walls (17, 18) delimiting a cavity (19), the rear wall (17) of said inner frame (13) comprising a first opening (20), providing communication between said upper compartment (3) and said cavity (19) and a plurality of holes (21), providing fluid communication between said lower compartment (4) and said cavity (19).

4. The gas cooker as claimed in claim 3, wherein said hob (22) comprises a plurality of exhaust passages (27), adapted to put in fluid communication said cavity (19) with an outside environment when said pivoting cover (24) is in lifted position, said exhaust path (38) comprising said first opening (20), said holes (21), said cavity (19) and said exhaust passages (27).

5. The gas cooker as claimed in claim 4, wherein said folded metal sheet (41) comprises a pair of side walls (44) and an upper surface (45) inclined with respect to said horizontal metal plate (5) with an inclination angle (β) ranging from 5° to 10°.

6. The gas cooker as claimed in claim 5, wherein front edges (46) of said side walls (44) and said upper surface (45) delimit a second substantially vertical front opening (47), said front edges (46) contacting the rear wall (17) of said inner frame (13) at said first opening (20) to provide fluid communication between said conduit (43) and said cavity (19).

7. The gas cooker as claimed in claim 5, further comprising a substantially vertical second baffle (40) accommodated in said cavity (19) and mounted to the rear wall (17) of said inner frame (13), said second baffle (40) being adapted to convey the fumes and the combustion products from said holes (21) to said exhaust passages (27).

8. The gas cooker as claimed in claim 1, further comprising a silicone seal (48) interposed between said front panel (35) and said horizontal metal plate (5) and contacting a top surface (9) of said first baffle (7).

9. A method of use of a gas cooker (1) in accordance with claim 4, said method comprising the steps of:

a) completely opening the pivoting door (31) of said oven (29);

b) moving said first baffle (7) from said first retracted position to said second extended position to provide fluid communication between said lower compartment (4) and said upper compartment (3) through said slits (6);

c) closing said pivoting door (31) to said partially open position, with an inner surface (34) of said pivoting door (31) abutting against said first baffle (7);

d) switching on the grill device (32) of said oven (29) using the control elements (37) positioned on said front panel (35); and e) lifting the pivoting cover (24) from the hob (22) to promote removal of the fumes and the combustion products by said conduit (43) and said exhaust passages (27).

* * * * *